United States Patent [19]

Parker et al.

[11] Patent Number: 4,847,655

[45] Date of Patent: Jul. 11, 1989

[54] HIGHLIGHT COLOR IMAGING APPARATUS

[75] Inventors: Delmer G. Parker; Jerome E. May, both of Rochester; William M. Allen, Jr., Webster, all of N.Y.

[73] Assignee: Xerox Corporation, Stamford, Conn.

[21] Appl. No.: 132,074

[22] Filed: Dec. 11, 1987

[51] Int. Cl.[4] ..... G03G 15/01

[52] U.S. Cl. ..... 355/210; 118/645; 346/157; 430/120; 355/245; 355/251; 355/328

[58] Field of Search ..... 355/3 DD, 4; 118/645, 118/656, 657, 658, 661; 346/157; 430/120, 122

[56] References Cited

U.S. PATENT DOCUMENTS

| | | | |
|---|---|---|---|
| 3,457,900 | 7/1969 | Drexler | 118/637 |
| 3,702,483 | 11/1972 | Fantuzzo | 346/157 |
| 4,308,821 | 1/1982 | Matsumoto et al. | 118/645 |
| 4,397,264 | 8/1983 | Hatch | 118/656 |
| 4,398,816 | 8/1983 | Nakajima et al. | 355/4 X |
| 4,416,533 | 11/1983 | Tokunaga et al. | 355/4 |
| 4,771,314 | 9/1988 | Parker et al. | 355/4 |

*Primary Examiner*—Fred L. Braun

[57] ABSTRACT

A magnetic brush developer apparatus including a plurality of developer housings each including a plurality of magnetic brush rolls associated therewith. Conductive magnetic brush (CMB) developer is provided in each of the developer housings. The CMB developer is used to develop electronically formed images. The physical properties such as conductivity, toner concentration and toner charge level of the CMB developers are such that density fine lines are satisfactorily developed notwithstanding the presence of relatively high cleaning fields.

13 Claims, 3 Drawing Sheets

HIGHLIGHT COLOR IMAGING APPARATUS

BACKGROUND OF THE INVENTION

This invention relates generally to the rendering of latent electrostatic visible using multiple colors of dry toner or developer and, more particularly, to a developer apparatus including structure for suppressing the development of the fringe fields of complementary tri-level images while developing acceptable line images, notwithstanding the presence of relatively high cleaning fields.

The invention can be utilized in the art of xerography or in the printing arts. In the practice of conventional xerography, it is the general procedure to from electrostatic latent images on a xerographic surface by first uniformly charging a photoconductive insulating surface or photoreceptor. The charge is selectively dissipated in accordance with a pattern of activating radiation corresponding to original images. The selective dissipation of the charge leaves a latent charge pattern on the imaging surface corresponding to the a reas not struck by radiation.

This charge pattern in made visible by developing it with toner. The toner is generally a colored powder which adheres to the charge pattern by electrostatic attraction.

The developed image is then fixed to the imaging surface or is transferred to a receiving substrate such as plain paper to which it is fixed by suitable fusing techniques.

The concept of tri-level xerography is described in U.S. Pat. No. 4,078,929 issued in the name of Gundlach. The patent to Gundlach teaches the use of tri-level xerography as a means to achieve single-pass highlight color imaging. As disclosed therein, the charge pattern is developed with toner particles of first and second colors. The toner particles of one of the colors are positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negatively and relatively positive toner particles. Such a developer is generally supplied to the charge pattern by cascading it a cross the imaging surface supporting the charge pattern. In another embodiment, the toner particles are presented to the charge pattern by a pair of magnetic brushes. Each brush supplies a toner of one color and one charge. In yet another embodiment, the development system is biased to about the b ackground voltage. Such biasing results in a developed image of improved color sharpness.

In tri-level xerography, the xerographic contrast on the charge retentive surface or photoreceptor is divided three, rather than two, ways as is the case in conventional xerography. The photoreceptor is charged, typically to 900v. It is exposed imagewise, such that one image corresponding to charged image areas (which are subsequently developed by charged area development, i.e. CAD) stays at the full photoreceptor potential ($V_{ddp}$ or $V_{cad}$, see FIGS. 1*a* and 1*b*). The other image is exposed to discharge the photoreceptor to its residual potential, i.e. $V_c$ or $V_{dad}$ (typically 100v) which corresponds to discharged area images that are subsequently developed by discharged-area development (DAD). The background areas exposed such as to reduce the photoreceptor potential to halfway between the $V_{cad}$ than $V_{white}$ (about 600v), and the DAD developer system is biased about 100v closer to $V_{dad}$ than $V_{white}$ (about 400v).

Various techniques have heretofore been employed to develop electrostatic images as illustrated by the following disclosures which may be relevant to certain aspects of the present invention.

As disclosed in U.S. Pat. No. 3,457,900, magnetic brushes have been designed to give fringe field or solid area development by adjusting the conductivity of the carrier. It is also stated therein that they can also be made to tone areas of less charge and clean areas of greater charge giving what is known in the art as a reverse development.

As discussed in U.S. Pat. No. 4,397,264 which relates to a conventional xerographic image development system, conductive magnetic brush (CMB) development and insulating magnetic brush (IMB) development systems suffer from limitations in their abilities to meet the full range of copy quality requirements. Specifically, insulating magnetic brush development systems have difficulty in using one developer roller to develop both lines and solid areas. In order to optimize solid area development with an insulating developer material, the spacing between the developer roller and photoconductive surface must be made quite small. However, low density fine line development occurs at a larger spacing to take advantage of the accuracy of fringe field development with insulating materials. This permits development with high cleaning fields so as to minimize background development.

As further discussed in U.S. Pat. No. 4,397,264 conductive magnetic brush development systems inherently fail to faithfully reproduce low density lines. Conductive developer materials are not sensitive to fringe fields. In order to achieve low density fine line development with conductive developer materials, the cleaning field must be relatively low. This produces relatively high background.

U.S. patent application Ser. No. 913,181 , now U.S. Pat. No. 4,761,668 filed on Sept. 29, 1986 Parker et al and assigned to the same assignee as the instant application which relates to tri-level printing discloses apparatus for minimizing the contamination of one dry toner or developer by another dry toner or developer used for rendering visible latent electrostatic images formed on a charge retentive surface such as a photoconductive imaging member. The apparatus causes the otherwise contaminating dry toner or developer to be attracted to the charges retentive surface in its inter-document and outboard areas. The dry toner or developer so attracted is subsequently removed from the imaging member at the cleaning station.

U.S. patent application Ser. No. 78,750, now U.S. Pat. No. 4,761,672 filed on July 28, 1987 in the name of Parker et al and assigned to the same assignee as the instant application which relates to tri-level printing discloses apparatus wherein undesirable transient development conditions that occur during start-up and shut-down in a tri-level xerographic system when the developer biases are either actuated or de-actuated are obviated by using a control strategy that relies on the exposure system to generate a spatial voltage ramp on the photoreceptor during machine start-up and shut-down. Furthermore, the development systems'bias supplies are programmed so that their bias voltages follow the photoreceptor voltage ramp at some predetermined offset voltage. This offset is chosen so that the cleaning field between any development roll and the photoreceptor is always within reasonable limits. As an alternative to synchronizing the exposure and developing characteristics, the charging of the photoreceptor can be varied in accordance with the change of developer bias voltage.

U.S. Pat. application Ser. No. 78,743 filed on July 28, 1987 in the name of Jerome May and assigned to the same assignee as the instant application which relates to tri-level printing discloses apparatus wherein undesirable transient development conditions that occur during start-up and shut-down in a tri-level xerographic system when the developer biases are either actuated or deactuated are obviated by the provision of developer apparatuses having rolls which are adapted to be rotated in a predetermined direction for preventing developer contact with the imaging surface during periods of start-up and shut-down. rolls of a selected developer housing or housings can be rotated in the contact-prevention direction to permit use of the tri-level system to be utilized as a single color system or for the purpose of agitating developer in only one of the housings at a time to insure internal triboelectric equlibrium of the developer in that housing.

U.S. patent application Ser. No. 947,321, now U.S. Pat. No. 4,771,314 filed on Dec. 29, 1986 in the name of Parker et al and assigned to the same assignee as the instant application which relates to tri-level printing discloses printing apparatus for forming toner images in black and at least one highlighting color in a single pass of a charge retentive imaging surface through the processing areas, including a development station, of the printing apparatus. The development station includes a pair of developer housings each of which has supported therein a pair of magnetic brush development rolls which are electrically biased to provide electrostatic development and cleaning fields between the charge retentive surface and the developer rolls. The rolls are biased such that the development fields between the first rolls in each housing and the charge retentive surface are greater than those between the charge retentive surface and the second rolls and such that the cleaning fields between the second rolls in each housing and the charge retentive surface are greater than those between the charge retentive surface and the first rolls.

U.S. patent application Ser. No. 95,486 filed on Aug. 31, 1987 in the name of Delmar Parker and assigned to the same assignee as the instant application which relates to tri-level printing discloses a magnetic brush developer apparatus comprising a plurality of developer housings each including a plurality of magnetic rolls associated therewith. The magnetic rolls disposed in a second developer housing are constructed such that the radial component of the magnetic force field produces a magnetically free development zone intermediate a charge retentive surface and the magnetic rolls. The developer is moved through the zone magnetically unconstrained and, therefore, subjects the image developed by the first developer housing to minimal disturbance. Also the developer is transported from one magnetic roll to the next. This apparatus provides an efficient means for developing the complementary half of a tri-level latent image while at the same time allowing the already developed first half to pass through the second housing with minimum image disturbance.

U.S. patent application Ser. No. 31,627 filed on March 3, 1987, and abandoned and filed as continuation application Ser. No. 220,408 on June 28, 1988 in the name of Parker et al and assigned to the same assignee as the instant application which relates to tri-level printing discloses an electronic printer employing tri-level xerography to superimpose two images with perfect registration during the single pass of a charge retentive member past the processing stations of the printer. One part of the composite image is formed using Magnetic Ink Character Recognition (MICR) toner, while the other part of the image is printed with less expensive black, or color toner. For example, the magnetically readable information on a check is printed with MICR toner and the rest of the check in color or in black toner that is not magnetically readable.

In tri-level xerography, the images comprise charged area images and discharged area images. Such images are commonly referred to as charged area development (CAD) images and discharged area development images, respectively. In a typical configuration where the charge retentive surface is uniformly charged negative, the CAD image is developed using a charged area development (CAD) system including a positive black toner with subsequent development of the discharged area using a discharged area development (DAD) system including a negative colored toner. When a CAD image or a background ($V_{white}$) region moves past the DAD housing a reverse development or cleaning field is established between the image and the developer rolls of that housing. The magnitude of the field is determined by the difference between the voltage level of the CAD image after development which is approximately equal to the CAD bias voltage $V_{bb}$(FIG. 1*b*), or the background, $V_{white}$ and the bias voltage on the discharged area development (DAD) system which is $V_{cb}$. The field thus established tends to cause the negative toner to migrate away from the photoreceptor towards the developer rolls. Thus, when a fine line moves trough the DAD developer housing, particularly with its smallest dimension travelling in the process direction, the development field generated by the fine line doesn't have time to attract enough toner that has drifted away from the photoreceptor surface into the developer back to the charge retentive surface to adequately develop the DAD fine line image. Because of the toner's inertia, it takes it a finite time for the toner to move in response to a rapidly changing development field, and in the case of a fine line, perpendicular to the process direction, there may not be sufficient time if the toner has migrated too far into the developer. Thus, line images may be improperly developed. This phenomenon is known as a developer history effect, which in this case is manifest as an underdeveloped fine line.

The shortcomings of CMB and IMB development systems discussed above with respect to conventional xerography have, heretofore, been present in highlight color xerography as well. In fact, the problem of not being to able to develop low density fine lines with CMB developer in the presence of relatively high cleaning fields has resulted in the wide use of IMB developer. However, in a tri-level highlight color system the use of IMB developer has been found to be unacceptable. Its use results in the development of fringe fields in a color different from the rest of the image. Thus, for example, in a system that uses black and red developers, the black images would have a red border around them while red images would have a black border around them.

The development of such fringe fields is caused by the reverse development or cleaning fields established between the developer biases and a complementary image (either developed or latent) on the charge retentive surface. The colored around the black image results from the field established due to the difference ($V_{bb}$-$V_{cb}$, see FIG. 1*b*) between the developer biases as the black images passes through the red developer housing while the black border around the red image results from the field established due to the difference ($V_{bb}$-$V_c$) between the bias on the black developer housing and the voltage level of the red latent image on the charge retentive surface as that image passes through the black developer housing.

Since the use of IMB developer has been found to be unacceptable in a tri-level highlight system for the reason noted, and since CM developer as disclosed in the prior art cannot develop line images in the presence of relatively high cleaning fields it would appear that tri-level highlight color imaging in a single pass is not viable.

BRIEF SUMMARY OF THE INVENTION

We have discovered that source of the failure of CMB developers in developing line images is attributable to certain properties of conventional developer materials as well as other aspects of the basic xerographic process. Thus, the development of optically (as opposed to electronically) formed images in ahighlight color system using CMB developer yields images that are not totally acceptable. Optical image formation systems typically possess a large degree of flare (non-image-forming light) which makes it difficult to develop fine lines using CMB developer, particularly when the smaller dimension of the image moves in the process direction. This, we found, is because the conductive developer, in the presence of large cleaning fields, moves toward the developer system, i.e. away from the imaging surface. Therefore, there isn't sufficient time for the toner to travel back to the imaging surface to adequately develop the line images. Even when electronically formed images have been used in highlight color systems, the resulting developed images were still not optimally formed. We discovered that the effects of adverse cleaning fields could be obviated by modifying the toner concentrations of conventional xerographic developers, which are too small (i.e. 1.0% by weight or less), and by modifying the charge levels of conventional xerographic developers, which are too high (i.e. 25 to 30 microcoulombs/gram), and further by spacing the developer rolls from the charge retentive surface at a distance in the order of 0.040 to 0.120 inch.

Briefly, the present invention uses a magnetic brush developer apparatus comprising a plurality of developer housings each including a plurality of magnetic rolls associated therewith. Conductive magnetic brush (CMB) developer is provided in each of the developer housings. The CMB developer is used to develop electronically formed images. The developer conductivity, as measured in a Gutman conductivity cell, is in the range of $10^{-9}$ to $10^{-13}$ (ohm-cm)$^{-1}$. The toner concentration of the developer is 2.0 to 3.0% by weight and the charge level is less than 20 microcoulombs/gram. Additionally, the developer rolls are spaced from the charge retentive surface a distance in the order of 0.040 to 0.120 inch.

DETAILED DESCRIPTION OF THE PREFERRED EMBODIMENT OF THE INVENTION

Figure 1A:
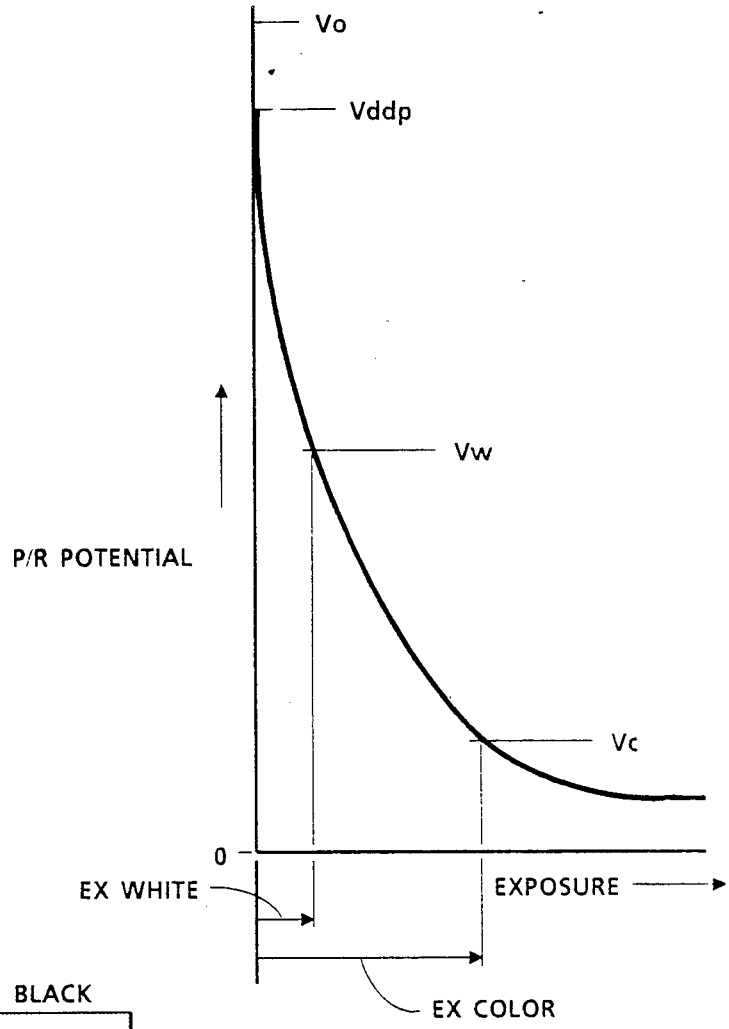
FIG. 1*a* is a plot of photoreceptor potential versus exposure illustrating a tri-level electrostatic latent image.
Figure 1B:
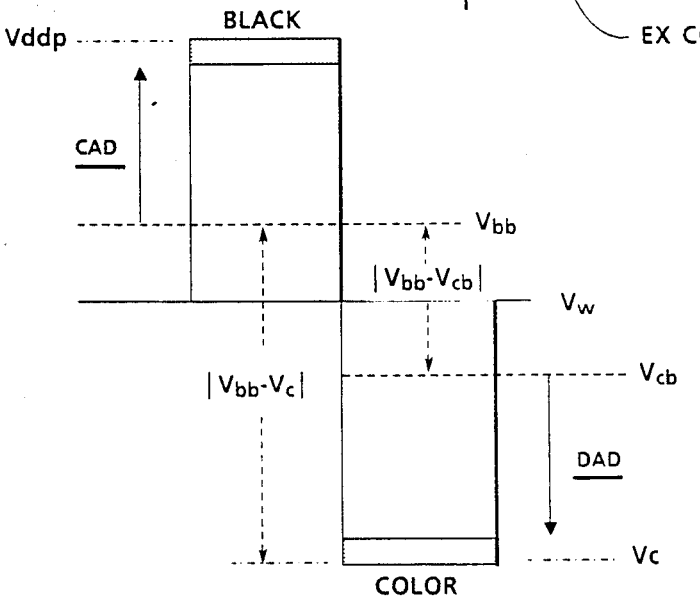
FIG. 1*b* is a plot of photoreceptor potential illustrating single-pass, highlight color latent image characteristics.

For a better understanding of the concept tri-level imaging, a description thereof will now be made with reference to FIGS. 1*a* and 1*b*. FIG. 1*a* illustrates the tri-level electrostatic latent image in more detail. Here $V_o$ is the initial charge level, $V_{ddp}$ the dark discharge potential (unexposed), $V_w$ the white discharge level and $V_c$ the photoreceptor residual potential (full exposure).

Color discrimination in the development of the electrostatic latent image is achieved by passing the photoreceptor through two developer housings in tandem which housings are electrically biased to voltages which are offset from the background voltage $V_w$, the direction of offset depending on the polarity or sign of toner in the housing. One housing (for the sake of illustration, the first) contains developer with black toner having triboelectric properties such that the toner is driven to the most highly charged ($V_{ddp}$) areas of the latent image by the electric field between the photoreceptor and the development rolls biased at $V_{bb}$ (V black bias) as shown in FIG. 1*b*. Conversely, the triboelectric charge on the colored toner in the second housing is chosen so that the toner is urged towards parts of the latent image at residual potential, $V_c$ by the electric field existing between the photoreceptor and the development rolls in the second housing at bias voltage $V_{cb}$ (V color bias).

Figure 2:
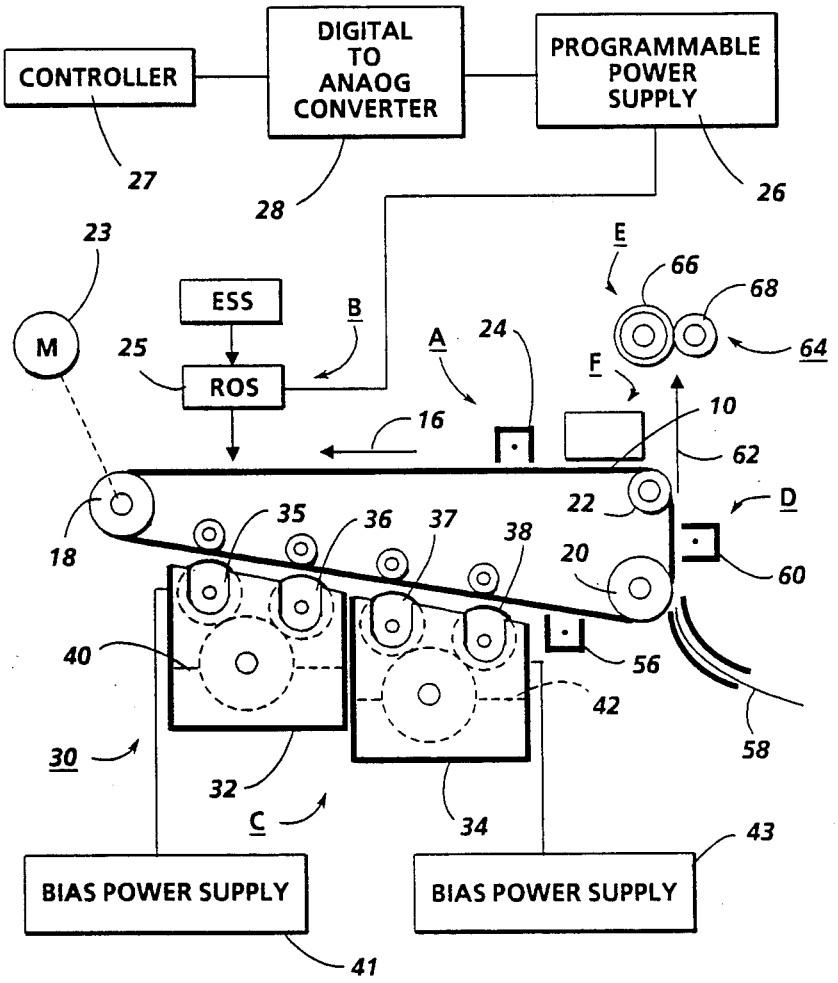
FIG. 2 is schematic illustration of a printing apparatus incorporating the inventive features of our invention.

As shown in FIG. 2, a printing machine incorporating our invention may utilize a charge retentive member in the form of a photoconductive belt 10 consisting of a photoconductive surface and an electrically conductive substrate and mounted for movement past a charging station A, an exposure station B, developer stations C, transfer station D and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used as a drive roller and the latter of which can be used to provide suitable tensioning of the photoreceptor belt 10. Motor 23 rotates roller 18 to advance belt 10 in the direction of arrow 16. Roller 18 is coupled to motor 23 by suitable means such as a belt drive.

As can be seen by further reference to FIG. 2, initially successive portions of belt 10 pass through charging station A. At charging station A, a corona discharge device such as a scorotton, corotron or dicorotron indicated generally by the reference numeral 24, charges the belt 10 to a selectively high uniform positive or negative potential, $V_o$. Preferably charging is negative. Any suitable control, well known in the art, may be employed for controlling the corona discharge device 24.

Next, the charged portions of the photoreceptor surface are advanced through exposure station B. At exposure station B, the uniformly charged photoreceptor or charge retentive surface 10 is exposed to a laser based input and/or output scanning device 25 which causes the charged retentive surface to be discharged in accordance with the output from the scanning device. Preferably the scanning device is a three level laser Raster Output Scanner (ROS). The ROS output is set via a programmable power supply 26 which driven by means of a controller 27 via a digital to analog converter 28. Alternatively, the ROS could be replaced by a conventional xerographic exposure device.

The photoreceptor, which is initially charged to a voltage $V_o$, undergoes dark decay to a level $V_{ddp}$. When exposed at the exposure station B it is discharged to $V_w$ imagewise in the background (white) image areas and to $V_c$ which is near zero or ground potential in the highlight (i.e. color other than black) color parts of the image. See FIG. 1*a*.

At development station C, a magnetic brush development system, indicated generally by the reference numeral 30 advances developer materials into contact with the electrostatic latent images. The development system 30 comprises first and second developer housings 32 and 34. Preferably, each magnetic brush development housing includes a pair of magnetic brush developer rollers. Thus, the housing 32 contains a pair of rollers 35, 36 while the housing 34 contains a pair of magnetic brush rollers 37, 38. Each pair of rollers advances its respective developer material into contact with the latent image. Appropriate developer biasing is accomplished via power supplies 41 and 43 electrically connected to respective developer housings 32 and 34.

Color discrimination in the development of the electrostatic latent image is achieved by passing the photoreceptor past the two developer housings 32 and 34 in a single pass with the magnetic brush rolls 35, 36, 37 and 38 electrically biased to voltages which are offset from the background voltage $V_w$, the direction of offset depending on the polarity of toner in the housing. One housing e.g. 32 (for the sake of illustration, the first) contains developer with black toner 40 having triboelectric properties such that the toner is driven to the most highly charged ($V_{ddp}$) areas of the latent image by the electrostatic field (development field) between the photoreceptor and the development rolls biased at $V_{bb}$ as shown in FIG. 1*b*. Conversely, the triboelectric charge on colored toner 42 in the second housing is chosen so that the toner is urged towards parts of the latent image at residual potential, $V_c$ by the electrostatic field (development field) existing between the photoreceptor and the development rolls in the second housing at bias voltages $V_{cb}$.

In an operative embodiment of the invention, good quality images including line images were produced using developers 40 and 42 which comprise cnductive magnetic brush (CMB) developer material with a conductivity in the range of $10^{-13}$ (ohm-cm)$^{-1}$. These developers comprise an insulative toner and a conductive carrier, the conductivity of the carrier being in the order of $10^{-9}$ to $10^{-10}$ (ohm-cm)$^{-1}$. The toner concentration of the developers 40 and 42 is in the order of 2.0to 3.0% by the weight and the charge level is less than 20 microcoulombs/gram. The developer rolls spaced from the charge retentive surface in the order of 0.040 to 0.120 inch.

In tri-level xerography, the entire photoreceptor voltage difference ($V_{ddp}$-$V_c$, as shown in FIG. 1*a*) is shared equally between the charged area development (CAD) and the discharged area development (DAD). This corresponds to approximately 800 volts (if a realistic photoreceptor value for $V_{ddp}$ of 900volts and a residual discharge voltage of 100 volts are assumed). Allowing an additional 100 volts for the cleaning fields ($V_{bb}$-$V_{white}$ and $V_{white}$-$V_{cb}$) in each development housing means an actual development contrast voltage for CAD of approximately 300 volts and an approximately equal amount for DAD. In the foregoing case the 300 volts of contrast voltage is provided by electrically biasing the first developer housing to a voltage level of approximately 600 volts and the second developer housing to a voltage level of 400 volts.

A sheet of support material 58 is moved into contact with the toner image at transfer station D. The sheet of support material is advanced to transffer station D by conventional sheet feeding apparatus, not shown. Preferably, sheet feeding apparatus includes a feed roll contacting the uppermost sheet of a stack of copy sheets. Feed rolls rotate so as to advance the uppermost sheet from the stack into a chute which directs the advancing sheet of support material into contact with photoconductive surface of belt 10 in a timed sequence so that the toner powder image developed thereon contacts the advancing sheet of support material at transfer station D.

Because the composite image developed on the photoreceptor consists of both positive and negative toner, a pre-transfer corona discharge member 56 is provided to condition the toner for effective transfer to a substrate using corona discharge.

Transfer station D includes a corona generating device 60 which sprays ions of a suitable polarity onto the backside of sheet 58. This attracts the charged toner powder images from the belt 10 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a backup roller 68. Sheet 58 passes between fuser roller 66 and backup roller 68 with the toner powder image contacting fuser roller 66. In this manner, the toner powder image is permanently affixed to sheet 58. After fusing, a chute, not shown, guides the advancing sheet 58 to a catch tray, also not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station F.

Subsequent to cleaning, a discharge lamp (not shown) floods the photoconductive surface with light to dissipate any residual electrostatic charge remaining prior to the charging thereof for the successive imaging cycle.

The magnetic brush rolls 35 and 36 may comprise any conventional structures known in the art that provides a magnetic field that forms the developer material in the housing 32 into a brush-like configuration in the development zone between the rolls 35 and 36 and the charge retentive surface. This arrangement effects development of one of the two tri-level images contained on the charge retentive surface in a well known manner.

The magnetic brush rolls 37 and 38 on the other hand are constructed such that development of the other of the two tri-level image is accomplished with minimal disturbance of the first image. To this end, the magnetic rolls 37 and 38 comprise magnetic force fields as depicted in FIGS. 3*a* and 3*b*, respectively. As shown therein, the radial force profiles of these two rolls are such as to cause developer to be picked up from the developer housing 32 and conveyed to the top of the roll 37 where the developer becomes magnetically unconstrained. The developer is moved through the development zone in a magnetically unconstrained manner until it is attracted to the roll 38 due to the radial magnetic forces of that roll. Magnetic poles are designated N (north) or S (south).

As illustrated in the drawings, the magnetic fields are plotted around the central axis of a two-roll magnetic brush development system such as the one comprising rolls 37, 38. For a multiple rolls development system comprising more than two rolls, roll 38 is replicated. The rolls are driven synchronously in this example, although it is also possible to have independent drive mechanisms for each roller.

Figure 3:
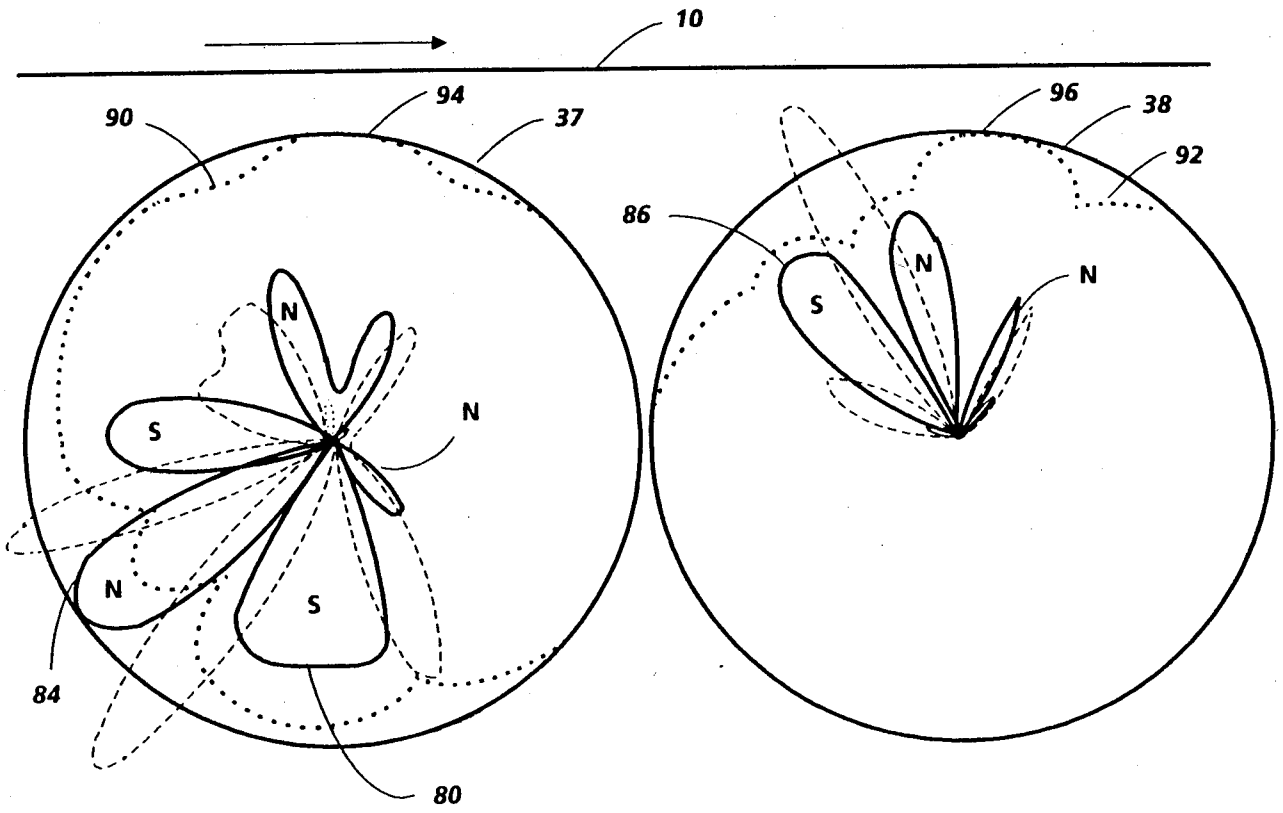
FIG. 3 is a plot of the magnetic fields around the central axis of a two-roll magnetic brush development system incorporated in the printing apparatus of FIG. 2.

FIG. 3 depicts the radial components, respectively, of rolls 37 and 38. As illustrated in the drawing, the magnetic fields are plotted around the central axis of a two-roll magnetic brush development system such as the one comprising rolls 37, 38. For a multiple roll development system comprising more than two rolls, roll 38 is replicated.

The development system additionally consists of a sump, or reservoir, of magnetic developer material, and optionally a mixing system, paddle wheel, or other apparatus to maintain the developing properties of the material in the sump. The developer rolls are rotating non-magnetic cylinders or shells having roughened or longitudinally corrugated surfaces to urge the developer along by frictional forces around fixed internal magnets. The shells are driven synchronously in this example; it is also possible to have independent drive mechanisms for each roller.

During the development process of the system, the direction of rotation of the shell around either fixed magnet is counterclockwise. However, the system can also be configured to develop in the clockwise direction with no compromise in performance, depending on the desired properties of the development system with respect to the direction of the photoreceptor (i.e., against-mode or with-mode development).

In the case described, the photoreceptor is located above the development rolls. The developer materials are transported from left to right from the sump to roll 37, to Roll 38, back to the sump.

A broad radial pole 80 of roll 37 (FIG. 3) positioned at 6 o'clock serves to lift magnetic developer material from a donor roll in the sump or housing 32. The combination of tangential and radial fields starting with pole 84 transport the developer material along the surface of the developer roll until about the 11 o'clock position of roll 37. At that point, the developer becomes magnetically unconstrained due to the lack of poles or strong poles in this area to constrain the developer in a brush-like configuration.

The developer is moved magnetically unconstrained through the part of the development zone delineated by the roll 37 and the charge retentive surface until the developer comes under the influence of a strong radial south pole 86 of the magnetic 38. Movement through the aforementioned zone is effected through the cooperation of the charge retentive surface and the developer shell. The pole 86 serves to effect transition of the developer from the roll 37 to the roll 38 without magnetically constraining the developer so as to cause scavenging of the first image as it passes the second developer housing. As will be observed, the poles following the pole 86 in the clockwise direction are progressively weaker so that the development zone delineated by the roll 38 and the charge retentive surface.

In view of the foregoing description it should now be apparent that there has been provided an image forming method and apparatus which forms tri-level images that are fringe-free and possess a high fidelity (i.e. a faithful reproduction of the original image) even when optically formed.

What is claimed is:

1. Method of forming fringe-free, tri-level images, said method including the steps of:

forming a tri-level latent electrostatic image on a charge retentive surface, said image comprising a first image area at a relatively high voltage level, a second image area at a relatively low voltage level and a background area half way between the voltage levels of said relatively high and low voltage levels;

electrically biasing a first developer member to a voltage level that is offset from said background area, in the direction of said first image area;

electrically biasing a second developer member to a voltage level that is offset from said background area, in the direction of said second image area;

using said first developer member, applying a first conductive magnetic brush developer, having physical properties for lessening the adverse effects of development of low density fine lines in the presence of high cleaning fields, to said charge retentive surface for developing a first image area; and using said second developer member, applying a second conductive magnetic brush developer, having physical properties for lessening the adverse effects of development of low density fine lines in the presence of high cleaning fields, to said charge retentive surface for developing said a second image area in a color different from said first image area.

2. The method according to claim 1 wherein said step of applying a first and second developer includes spacing said first and second developer members away from said charge retentive surface a distance in the order of 0.040 to 0.120 inch.

3. The method according to claim 2 wherein the conductivity of said developer is in the order of $10^{-9}$ to $10^{-13}$ (ohm-cm)$^{-1}$.

4. The method according to claim 3 wherein the toner concentration of said developer is in the order of 2.0 to 3.0% by weight.

5. The method according to claim 4 wherein the charge level of said developers is less than 20 microcoulombs/gram.

6. The method according to claim 1 wherein the step of forming a tri-level latent electrostatic image is effected electronically.

7. Apparatus for forming high fidelity and fringe free, tri-level images, said apparatus comprising means for forming a tri-level latent electrostatic image on a charge retentive surface, said image comprising a first image area at a relatively high voltage level, a second image area at a relatively low voltage level and a background area half way between the voltage levels of said relatively high and low voltage levels;

a first development system including means for applying a first conductive magnetic brush developer to said charge retentive surface for developing a first image area and means for electrically biasing a first developer member to a voltage level that is offset from said background area, in the direction of said first image, said first development system containing means for counteracting the adverse affects of relatively high cleaning fields on the developer to thereby permit proper line image development; and a second development system including means for applying a second conductive magnetic brush developer to said charge retentive surface for developing said a second image area in a color different from said first image area and means for electrically biasing a second developer member to a voltage level that is offset from said background area, in the direction of said second image area, said second development system containing means for counteracting the adverse affects of relatively high cleaning fields on the developer to thereby permit proper line image development.

8. The apparatus according to claim 7 wherein said counteracting means comprises developer materials having properties which lessen the adverse effects of relatively high cleaning fields on line image development.

9. The apparatus according to claim 8 wherein said tri-level latent electrostatic image is formed electronically.

10. The apparatus according to claim 9 wherein said first and second developer members are spaced away from said charge retentive surface a distance in the order of 0.046 to 0.120 inch.

11. The apparatus according to claim 10 wherein the conductivity of said developer is in the order of $10^{-9}$ to $10^{-13}$ (ohm-cm)$^{-1}$.

12. The apparatus according to claim 11 wherein the toner concentration of said developer is in the order of 2.0 to 3.0% by weight.

13. The apparatus according to claim 12 wherein the charge level of said developers is less than 20 microcoulombs/gram.

* * * * *